United States Patent [19]

Castonguay et al.

[11] Patent Number: 4,553,119

[45] Date of Patent: Nov. 12, 1985

[54] ELECTRIC CIRCUIT BREAKER HAVING REDUCED ARC ENERGY

[75] Inventors: Roger N. Castonguay, Terryville; Charles L. Jencks, Avon, both of Conn.

[73] Assignee: General Electric Company, New York, N.Y.

[21] Appl. No.: 609,053

[22] Filed: May 10, 1984

[51] Int. Cl.[4] ..... H01H 77/10

[52] U.S. Cl. ..... 335/147; 335/16; 335/192; 335/194

[58] Field of Search ..... 335/16, 195, 40, 192, 335/194, 147

[56] References Cited

U.S. PATENT DOCUMENTS 2,944,129 7/1960 Cole et al. ..... 335/147
3,192,344 6/1965 Cole ..... 335/147
3,517,355 6/1970 Cole ..... 335/16
4,458,224 7/1984 Kralik et al. ..... 335/195

FOREIGN PATENT DOCUMENTS 2522211 12/1975 Fed. Rep. of Germany ..... 335/195

*Primary Examiner*—Harold Broome
*Attorney, Agent, or Firm*—Richard A. Menelly; Walter C. Bernkopf; Fred Jacob

[57] ABSTRACT

An electric circuit breaker having fast short circuit response along with reduced arc energy is provided by means of a current limiting contact arm arrangement. The contact arm is arranged to pivot independently of the circuit breaker operating mechanism under the influence of magnetic repulsion forces. A contact spring configuration controls the rate at which the contacts separate, thereby limiting the energy of the arc created upon contact separation.

5 Claims, 3 Drawing Figures

ELECTRIC CIRCUIT BREAKER HAVING REDUCED ARC ENERGY

BACKGROUND OF THE INVENTION

Molded case industrial circuit breakers provided with a movable contact arm capable of pivoting to an open position called the "blow open position" independent of the circuit breaker operating mechanism are capable of limiting the current through the contacts under short circuit fault conditions. The rapid separation of the contacts in the early stages of the current waveform effectively limits the total amount of current between the contacts when the arc forms upon such separation. Earlier contact arm and contact spring arrangements for such current limiting are disclosed in U.S. patent application Ser. No. 479,617 filed Mar. 28, 1983 entitled "Electric Circuit Breakers Having Fast Short Circuit Response', and U.S. patent application Ser. No. 479,616 filed Mar. 28, 1983 and entitled "Variable Torque Contact Arm For Electric Circuit Breakers". Both of these patent applications are incorporated herein for purposes of reference. The main advantage achieved by current limiting is the reduction of the effective thermal energy dissipated within the breaker measured as the product of the square of the arc current multiplied by the time that the arc continues to exist. By interrupting the current through the breaker early in the current waveform, however, the voltage across the breaker components is at a high value. The arc energy, as measured by the product of the voltage and the current multiplied by the time that the arc persists, is also at a relatively high value. The higher the arcing energy within the breaker, the larger the arc chute requirement in order to absorb the arc energy without damaging the breaker components.

The main advantage achieved by the "current limiting" provided by the independently pivoting contact arm upon short circuit fault conditions is the wide range of current ratings that can be safely handled by a single breaker geometry. Heretofore, it has been customary to increase the size of the breaker components in proportion to the current rating which usually resulted in a larger overall breaker geometry. As described within the aforementioned U.S. Patent Applications, some components within the standard size breaker geometry must be increased in order to deter overheating during normal operating conditions. One such component is the flexible braid which is attached to the movable contact arm on the line side of the circuit breaker. The large braid could present a space problem since the contact arm upon opening independent of the operating mechanism repositions the braid such that it comes in near contact with the breaker components which are operatively positioned by means of the operating mechanism.

The arcing energy that is generated during a circuit interruption must not exceed the energy that a breaker can withstand without damage. As described earlier, one breaker design can have different voltage and current ratings. Lower system voltages, for example, generally have higher current interrupting ratings.

The purpose of this invention is to provide a contact arm and contact spring configuration that allows more effective current limiting on low voltage systems where the available current is higher, and less current limiting on higher voltage systems where the available current is lower. A further purpose of the invention is to provide means for allowing the braid to move within the breaker housing without interfering with any other breaker components when the operating mechanism is bypassed and the contact arm operates under short circuit conditions.

SUMMARY OF THE INVENTION

The invention comprises a contact arm and contact spring arrangement wherein the spring exhibits a double pivot with respect to the fixed pivot of the movable contact arm. The spring is arranged to provide a high contact closing force in one pivot location and rotates to a second pivot location during the rapid rotation of the movable contact arm under the influence of magnetic repulsive forces. The second pivot location multifunctionally allows clearance for the terminal braid attached to the movable contact arm as well as increasing the force on the movable contact arm during magnetic repulsion to allow current limiting without excessive arc energy.

DESCRIPTION OF THE PREFERRED EMBODIMENT

Figure 1:
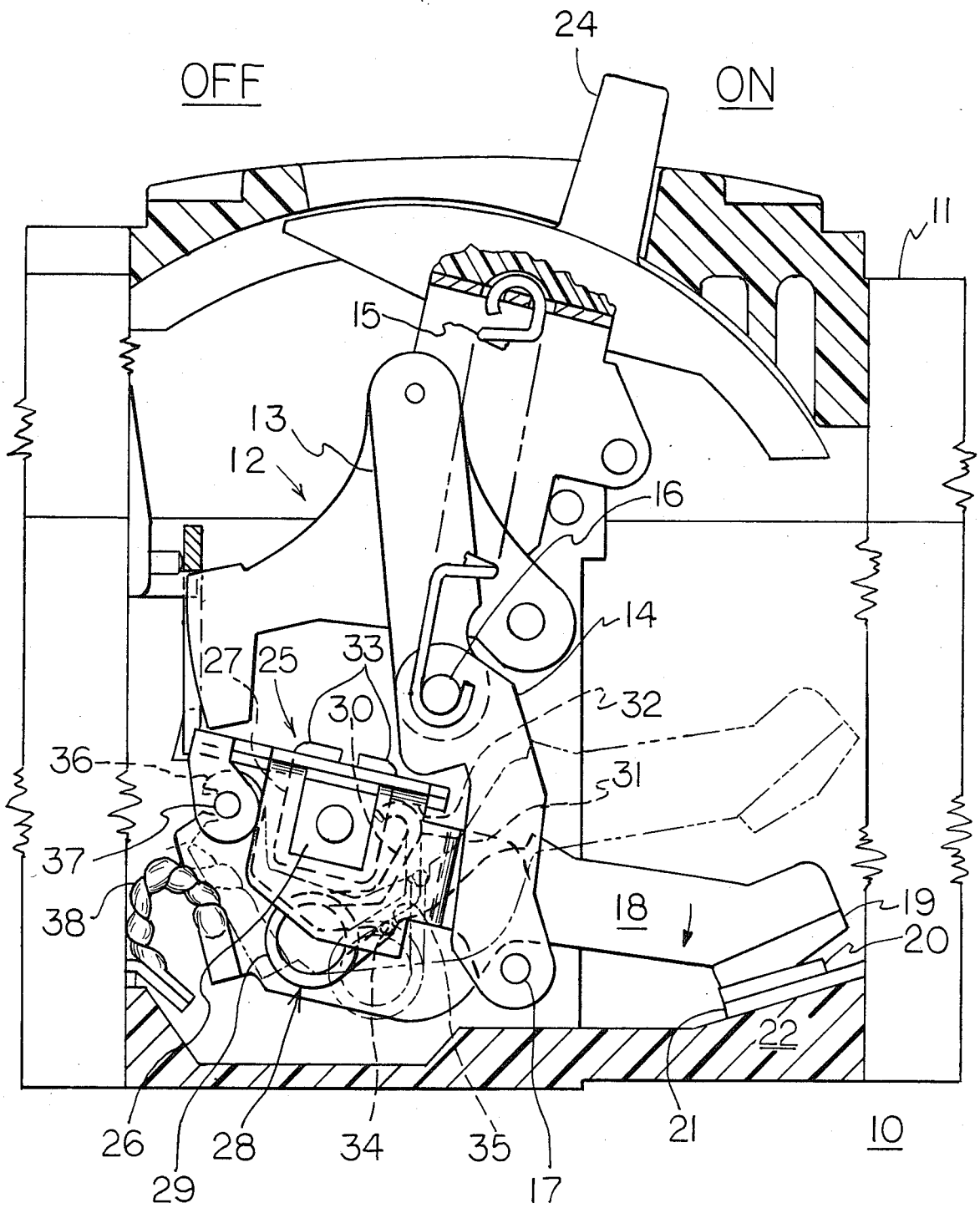
FIG. 1 is a side view of an industrial rated molded case circuit breaker partially exposed to show the contact operating mechanism.

FIG. 1 shows an industrial-type molded case circuit breaker 10 of the type described within U.S. Pat. No. 3,564,184 to George E. Gauthier et al. This patent is incorporated herein for purposes of reference and a more detailed description of a circuit breaker operating mechanism can be found therein. For this invention, it suffices to indicate a molded case 11 containing an operating mechanism generally indicated at 12 and consisting of an upper and lower link 13, 14 joined together by a toggle pin 16 which also anchors one end of an operating spring 15. The other end of the operating spring is connected to an ON/OFF handle 24. A movable S-shaped contact arm 18 is supported by means of a pin 17 extending through the lower link 14 and contact carrier 25 for lifting the movable contact arm 18 from a closed position wherein the movable and fixed contacts 19, 20 are in electrical connection with each other to the open position (not shown). A contact carrier 25 is attached to the circuit breaker crossbar 26 by means of a staple 27 and by means of tabs 33 as shown. The movable contact arm 18 is pivotally attached to the contact carrier by means of a hook-shaped end 36 on the contact arm and a pivot pin 37. A contact spring 28, fabricated from a continuous length of spring wire and having a plurality of body windings 29 arranged on either side of the movable contact arm 18, is attached to the contact carrier 25 by means of a pair of hooked ends 31 which are supported by a corresponding surface 32 on the contact carrier 25. A pair of spring legs 30 connect between the hooked ends 31 and the body windings 29. A crossover arm 34, best seen in FIG. 2, connects between the body windings 29 and rests in a V-shaped groove 35 cut within the top of the movable contact arm 18. The contact spring provides a downwardly directed force between the movable and fixed contacts 19, 20 to insure a low resistance connection therebetween. A terminal strap 21 provides electrical connection with the fixed contact 20 and is supported by a bottom support 22 formed within the molded case 11. Electrical connection with the movable contact arm 18 is provided by means of a wire braid 38 which is fixedly attached to the movable contact arm 18 by a welding or brazing operation. It can be seen by comparing the movable contact arm between its closed position and the blow open position indicated in phantom that the contact spring 28 also moves along with the movable contact arm to a new position also indicated in phantom. The movement of the contact arm 18 from a first to a second blow open position forces the crossover arm 34 on the spring to move the contact spring 28 to the second position since the hooked spring ends 31 pivot on the surface 32 of contact carrier 25.

Figure 2:
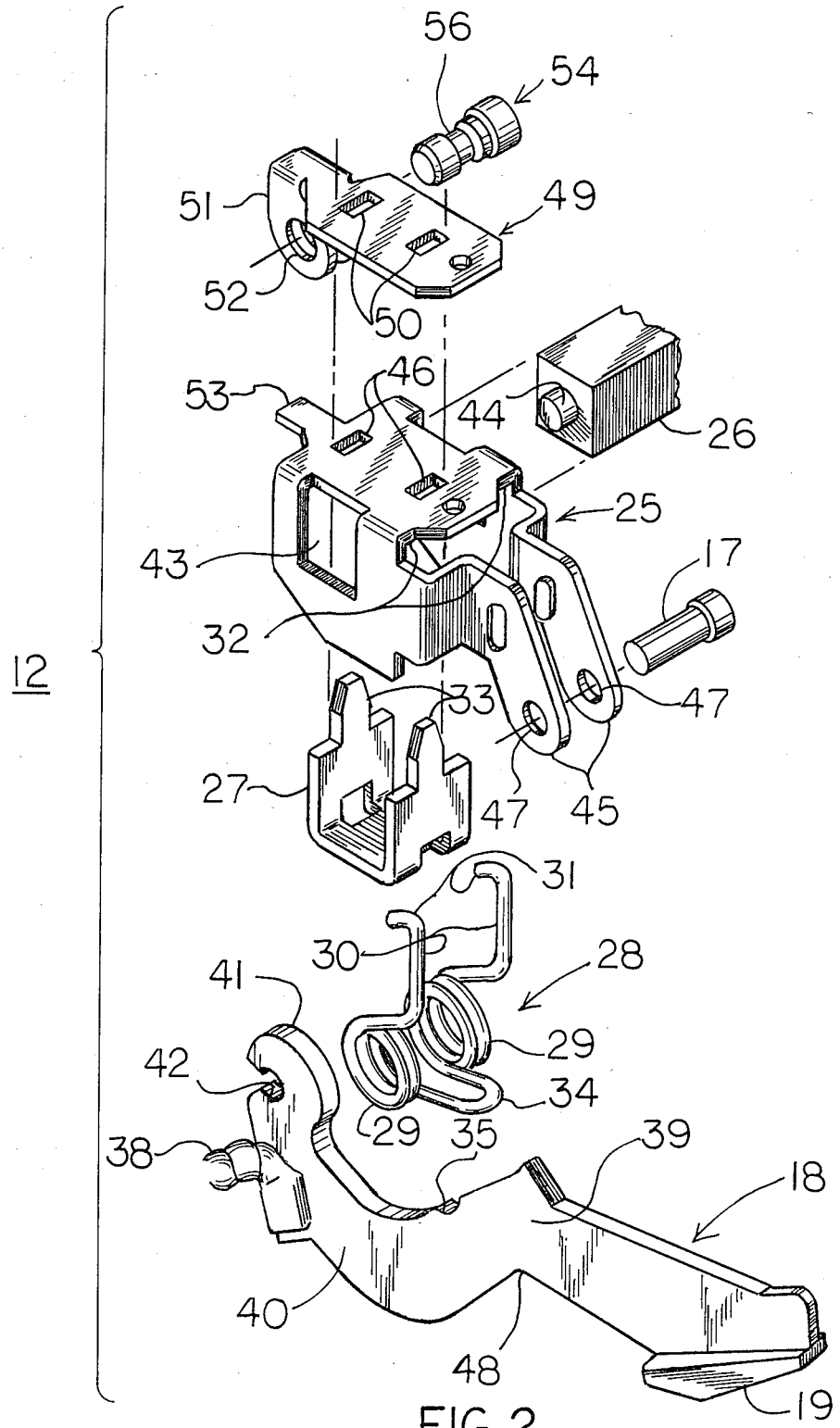
FIG. 2 is a top perspective view in isometric projection of the movable contact arm mounting arrangement depicted in FIG. 1.

The movable contact arm 18 shown in FIG. 2 has a configuration similar to that described within the aforementioned U.S. patent application Ser. No. 479,617. A movable contact 19, consisting of a good electrically conducting metal such as silver, is welded at one end of the movable contact arm 18 which is generally fabricated from a flat plate of copper or copper alloy. The hook-shaped end 41 contains a slot 42 for pivotally attaching to the contact carrier, generally indicated as 49, in a manner to be described below. A kneebend 39 is formed within the movable contact arm 18 having a well-defined contact arm support pin receiver 48 formed therein. The hook-shaped bend 40 to which the wire braid 38 is attached has a V-shaped cut 35 to accept the spring crossover arm 34.

Figure 3:
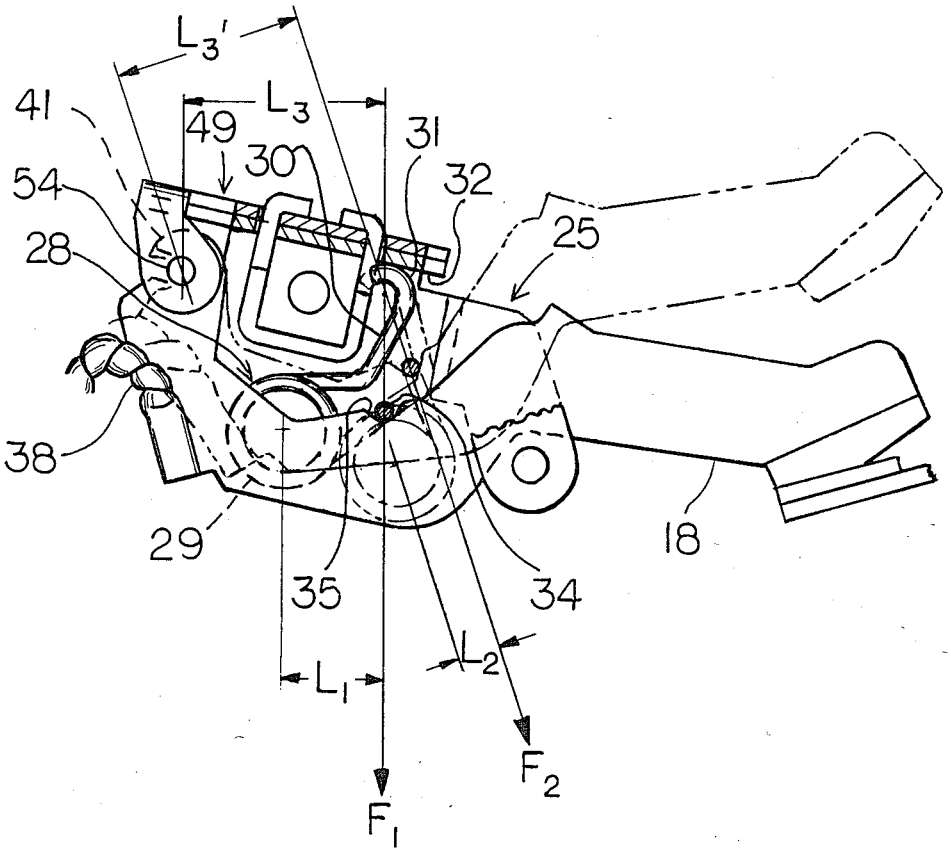
FIG. 3 is a side view of the assembled movable contact arm mounting arrangement depicted in FIG. 2 with the contact spring illustrated in two separate locations.

In assembling the movable contact arm 18 to the contact carrier 25, the contact carrier is first attached to the crossbar 26 by inserting the crossbar within the crossbar slot 43 and the crossbar is later pivotally mounted within the circuit breaker by means of the pivot projection 44. A pivot carrier 49 having a formed yoke 51 and a pair of holes 52 is arranged over the contact carrier by bottoming the yoke against the projecting tab 53 on the contact carrier and inserting the staple tabs 33 through a corresponding pair of parallel slots 46 on the top of the carrier 25 and slots 50 in carrier 49 and folding the tabs down as shown in FIG. 3. The contact carrier spring 28, described earlier as having a pair of hooked ends 31 interconnecting with a pair of spring body windings 29 by means of spring legs 30 and interconnecting the spring body windings by means of a crossover arm 34, is attached in the following manner. The hooked ends 31 are placed against the corresponding surface 32 on contact carrier 25. The contact arm pivot pin 54 is inserted through the pivot carrier yoke hole 52. The contact arm 18 is then mounted by placing slot 42 over bearing diameter 56 on pin 54 and rotating the arm counterclockwise until the crossover arm 34 of contact spring 28 is trapped within the "V" slot 35 on the movable contact arm 18. The movable contact arm is further rotated counterclockwise about the attached pivot pin 54 winding up contact spring 28. The kneebend 39 passes between the parallel pair of contact carrier legs 45 and a contact arm support pin 17 is inserted through a pair of holes 47 at the bottom end of the contact carrier legs. The movable contact arm 18 is held within the contact carrier 25 by contact spring 28 biasing the formed surface 48 of arm 18 against pin 17. The provision of a V-shaped groove 35 on the movable contact arm 18 forces the contact spring crossover arm 34 to move as described earlier with reference to FIG. 1. This differs from the arrangement described within aforementioned U.S. patent application Ser. No. 479,617 wherein the contact spring body windings are retained by the contact arm pivot pin which prevented the contact spring from changing positions. This resulted in a nearly constant spring force on the movable contact arm as the contact arm moved from a first position to a second position due to magnetic forces as described earlier. The instant design differs from that disclosed within U.S. patent application Ser. No. 479,616 wherein the contact spring crossover arm was allowed to move in relation to the contact arm, but the contact spring was restrained from motion. This resulted in a high initial torque on the movable contact arm which dropped nearly to zero in a short period of time.

As described earlier, allowing the movable contact arm to separate the contacts early in the current waveform provided current limiting function to the breaker, but resulted in higher arc voltages when used within high interruption rated circuit breakers. The provision of a contact spring 28 which allows the body windings 29 to move from a first position with the contacts closed to a second position with the contacts blown open, as shown in FIGS. 1 and 3, allows the contacts to open at a controlled rate. In the case of high voltage low current circuits, it is important to control the rate of contact opening with respect to the current waveform to minimize the amount of arcing energy that must be dissipated within the breaker. The rate of contact opening is controlled by allowing the contact spring force to increase at a controlled rate during the short circuit fault condition. This is seen by comparing the location of the contact spring 28 when the movable contact arm 18 is in its closed position as indicated in solid lines in FIG. 3, to the location of the contact spring when the movable contact arm is in the blow open position indicated in phantom. When contact arm 18 is forced to the blow open position shown in phantom in FIG. 3, contact spring 28 is forced to rotate to the position also shown in phantom. It can be seen that force $F_2$, which is the force exerted by contact spring 28 when contact arm 18 is in the blow open position, is considerably higher than force $F_1$, which is the force exerted by the contact spring 28 when contact arm 18 is in the closed position. This is not only due to the spring gradient exerted by the stressed contact spring 28, but also because the lever arm $L_2$ exerted against the contact spring by contact arm 18 when the contact arm is in the blow open position is smaller than the lever arm $L_1$ exerted by the contact arm 18 on the contact spring when the contact arm is not in the blow open position. $L_1$ and $L_2$ are both measured from the center of the spring body windings 29 to the center of the spring crossover loop 34 as indicated. This results in a resisting force exerted by contact spring 28 on contact arm 18 greater than could be exerted by the spring gradient alone. $L_3$, $L_3'$ represents the lever arms measured from the contact arm pivot pin 54 to the center of spring ends 31 where the spring forces $F_1$ and $F_2$ are concentrated, when the contact arm 18 is in the closed and blow open positions respectively. Since $L_3$ and $L_3'$ are equal, the resisting force on contact arm 18 increases as rapidly as the contact spring force increases. The increased resisting force on the contact arm 18 now controls the rate of opening of the contact arm relative to the current waveform. Since current limiting is more effective at high rated currents within low voltage circuits, and less effective at low rated currents within high voltage circuits, this arrangement of the contact arm 18 and contact spring 28 results in a nearly constant arc energy within a single breaker design for all current and voltage ratings.

The wire braid 38 shown in FIG. 3 is forced by the movable contact arm 18 to the position shown in phantom when contact arm 18 moves to the blow open position. It is thus seen that the contact arm 18 positions the wire braid 38 in the manner described earlier for positioning contact spring 28. This allows the wire braid 38 to occupy the space vacated by the contact spring 28.

It is thus seen that the arrangement of the movable contact arm 18 and the dual position contact spring 28 multifunctionally allows a fixed breaker geometry to cover a wide range of breaker voltage and current ratings without substantial redesign of the breaker housing or components. The provision of the second location of the contact spring is also seen to allow the braid to move with the contact arm without interfering with the other breaker components.

We claim:

1. A molded case circuit breaker comprising:

a trip unit for sensing current flow through a pair of fixed and movable contacts and for activating a linked toggle operating mechanism to interrupt current flow through the contacts for generating an arc voltage across said contacts;

a contact carrier for supporting a movable contact arm having said movable contact at one end and a pivot at an opposite end;

a contact spring mounted on said contact carrier and arranged on said movable contact arm to provide a first force on said movable contact arm at a first predetermined distance from said pivot when a first amount of current flows through said contacts and becomes displaced to a second predetermined distance from said pivot to provide a second force on said movable contact arm when a second amount of current flows between said contacts, said second current being larger than said first current and said second force being larger than said first force to thereby control the magnitude of said arc voltage.

2. The circuit breaker of claim 1 wherein said movable contact arm is pivotally supported at one end on said contact carrier for becoming magnetically repelled away from said fixed contact when said second current flows between said pair of contacts.

3. The circuit breaker of claim 1 wherein said contact spring comprises a continuous length of spring steel formed into a pair of parallel arranged body windings one on each side of said movable contact arm and pair of parallel arranged hooked ends joined by means of a crossover arm across said movable contact arm perpendicular to said hooked ends.

4. The circuit breaker of claim 3 wherein said contact carrier is mounted to a crossbar by means of a staple and wherein said contact spring hook ends are retained between said crossbar and said contact carrier.

5. The circuit breaker of claim 3 wherein said contact arm is formed in an S-shaped configuration, said contact arm being connected to said linked toggle by a support pin under one side of said "S" and said contact spring crossover arm being supported on an opposite side of said "S".

* * * * *